US007331128B1

(12) United States Patent
Navasky et al.

(10) Patent No.: US 7,331,128 B1
(45) Date of Patent: Feb. 19, 2008

(54) DECORATIVE VAMP SYSTEM

(76) Inventors: Edward Navasky, 309 School St., Philipsburg, PA (US) 16866; Stephanie Williams, 10341 Bellwood Ave., Century City, CA (US) 90064

( * ) Notice: Subject to any disclaimer, the term of this patent is extended or adjusted under 35 U.S.C. 154(b) by 365 days.

(21) Appl. No.: 10/711,344

(22) Filed: Sep. 13, 2004

Related U.S. Application Data

(60) Provisional application No. 60/521,512, filed on May 10, 2004.

(51) Int. Cl.
*A43B 3/24* (2006.01)

(52) U.S. Cl. ..... 36/101

(58) Field of Classification Search ..... 36/101, 36/100, 136
See application file for complete search history.

(56) References Cited

U.S. PATENT DOCUMENTS

| | | | | |
|---|---|---|---|---|
| 2,068,946 | A * | 1/1937 | Ferguson | 36/1 |
| 2,887,792 | A * | 5/1959 | Staff | 36/100 |
| 2,948,070 | A * | 8/1960 | Lewis | 36/100 |
| 3,032,896 | A * | 5/1962 | Weaver | 36/101 |
| 3,972,136 | A * | 8/1976 | Epstein | 36/101 |
| 4,372,060 | A * | 2/1983 | Adamik | 36/54 |
| 6,212,797 | B1 * | 4/2001 | Merry et al. | 36/101 |
| 6,430,845 | B1 * | 8/2002 | Noda | 36/100 |
| 6,898,873 | B2 * | 5/2005 | Schenone | 36/112 |
| 2003/0177664 | A1 * | 9/2003 | Monassebian | 36/100 |
| 2004/0128862 | A1 * | 7/2004 | Flack | 36/100 |
| 2005/0066550 | A1 * | 3/2005 | Liu | 36/101 |
| 2005/0268495 | A1 * | 12/2005 | Schenone | 36/100 |

* cited by examiner

*Primary Examiner*—Ted Kavanaugh
(74) *Attorney, Agent, or Firm*—John J. Elnitski, Jr.

(57) ABSTRACT

A decorative vamp system for shoes. The decorative vamp system allows the appearance of the vamp of a shoe to be changed to match the clothing of the wearer. The decorative vamp system includes the shoe with a fixed vamp, a removable vamp insert, a tongue flap and a receiving lip. The removable vamp insert is held in place by the receiving lip and the tongue flap. The removable vamp insert is removable from the shoe to allow changing of the appearance of the vamp of the shoe. Additional materials can be used between the removable vamp insert and the fixed vamp to provide a frictional force between the removable vamp insert and the fixed vamp to further hold the removable vamp insert in place.

14 Claims, 6 Drawing Sheets

DECORATIVE VAMP SYSTEM

BACKGROUND

The present invention generally relates to shoes. More specifically, the present invention relates to a system providing for a removable shoe vamp.

Shoes are considered an important accessory to clothing. Shoes can be purchased in a plain variety or can be purchased in a stylized variety. The plain variety of shoe can be coordinated with different clothing. The stylized variety of shoe is usually limited to be wore with only certain clothing in a wardrobe. Clothing and shoes are expensive to purchase, so most purchases are limited to plain varieties which can be coordinated with each other. What is needed is a stylized shoe which can be changed depending on the clothing to be wore.

It is an object of the present invention to provide system for a shoe with a removable vamp.

SUMMARY OF THE INVENTION

A decorative vamp system for shoes. The decorative vamp system allows the appearance of the vamp of a shoe to be changed to match the clothing of the wearer. The decorative vamp system includes the shoe with a fixed vamp, a removable vamp insert, a tongue flap and a receiving lip. The removable vamp insert is held in place by the receiving lip and the tongue flap. The removable vamp insert is removable from the shoe to allow changing of the appearance of the vamp of the shoe. Additional materials can be used between the removable vamp insert and the fixed vamp to provide a frictional force between the removable vamp insert and the fixed vamp to further hold the removable vamp insert in place.

DETAILED DESCRIPTION

Figure 1:
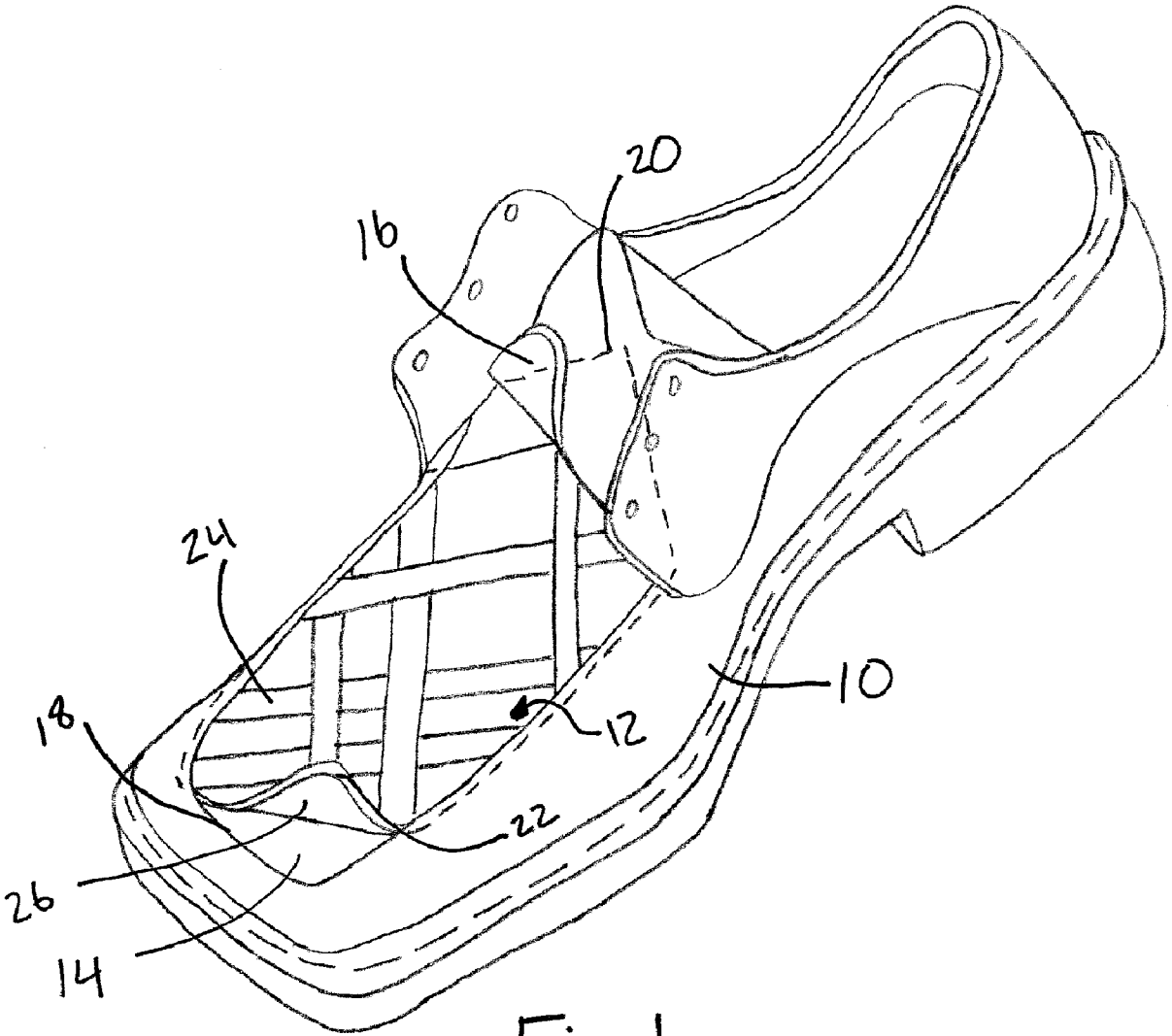
FIG. 1 is a perspective view of a shoe with a removable vamp according to the present invention.
Figure 2:
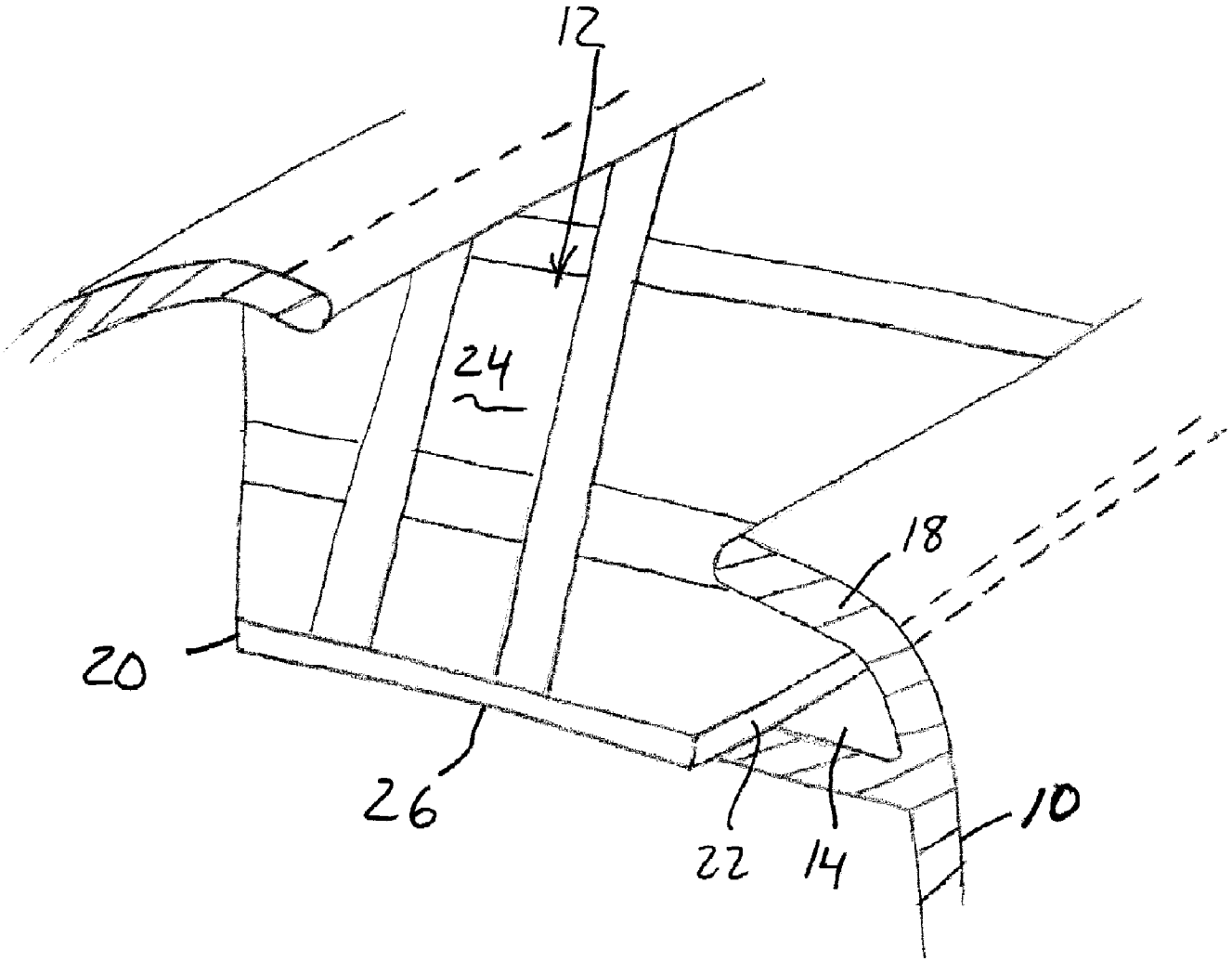
FIG. 2 is a perspective view of a secured removable vamp of the shoe of FIG. 1 according to the present invention.

The present invention is a decorative vamp system for shoes. The decorative vamp system allows the appearance of the vamp of a shoe to be changed to match the clothing of the wearer. FIGS. 1-6 show a shoe 10 with a removable vamp insert 12. The shoe 10 of FIGS. 1-2 includes a fixed vamp 14, the removable vamp insert 12, a tongue flap 16 and a receiving lip 18. FIG. 1 shows the removable vamp insert 12 being held in place on the shoe 10 by the receiving lip 18. FIG. 2 shows a close up of the receiving lip 18 looking from the tongue area downward. The removable vamp insert 12 includes a tongue end 20 which fits under the tongue flap 16. The tongue flap 16 is a piece of material attached to the tongue of the shoe 10 to hold the removable vamp insert 12 in place. The removable vamp insert 12 is placed over the fixed vamp 14 with an outside edge 22 of the removable vamp insert 12 placed into the receiving lip 18 and with the tongue end 20 placed under the tongue flap 16. The fixed vamp 14 can be decorative in nature, such as an alligator skin pattern. A decorative fixed vamp allows use of the shoe 10 without the removable vamp insert 12. The removable vamp insert 12 has an outside layer 24 and an inside layer 26. The outside layer 24 is a decorative layer, which could be anything from a fabric material to a leather material. The inside layer 26 is the part of the removable vamp insert 12 which contacts the fixed vamp 14. The inside layer 26 could be a material which provides a frictional force between the inside layer 26 and the fixed vamp 14 to prevent movement of the removable vamp insert 12. The removable vamp insert 12 can be used with the shoe 10 of FIG. 1 without a tongue flap 16.

Figure 3:
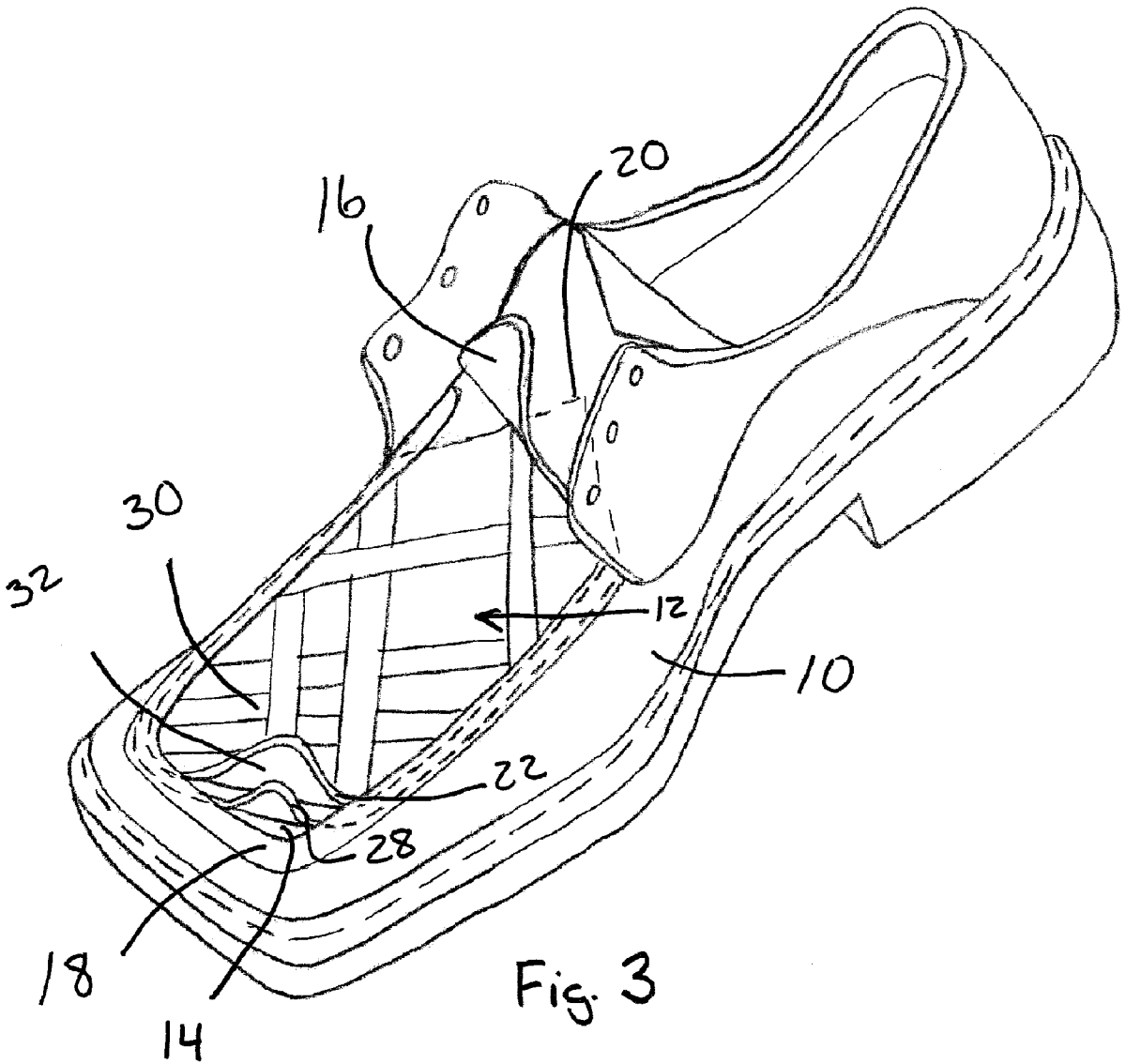
FIG. 3 is a perspective view of another shoe with a removable vamp according to the present invention.
Figure 4:
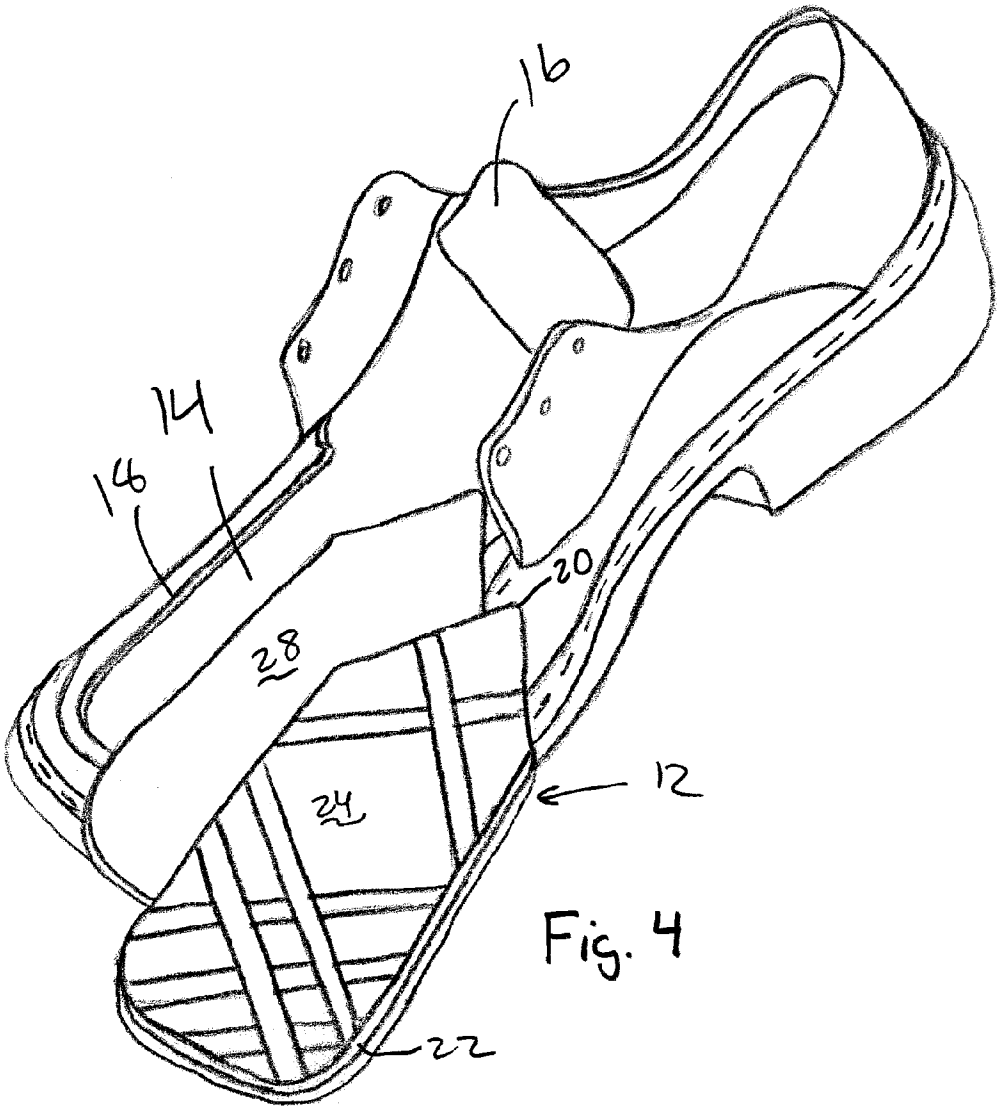
FIG. 4 is an explode of the shoe of FIG. 3 according to the present invention.
Figure 5:
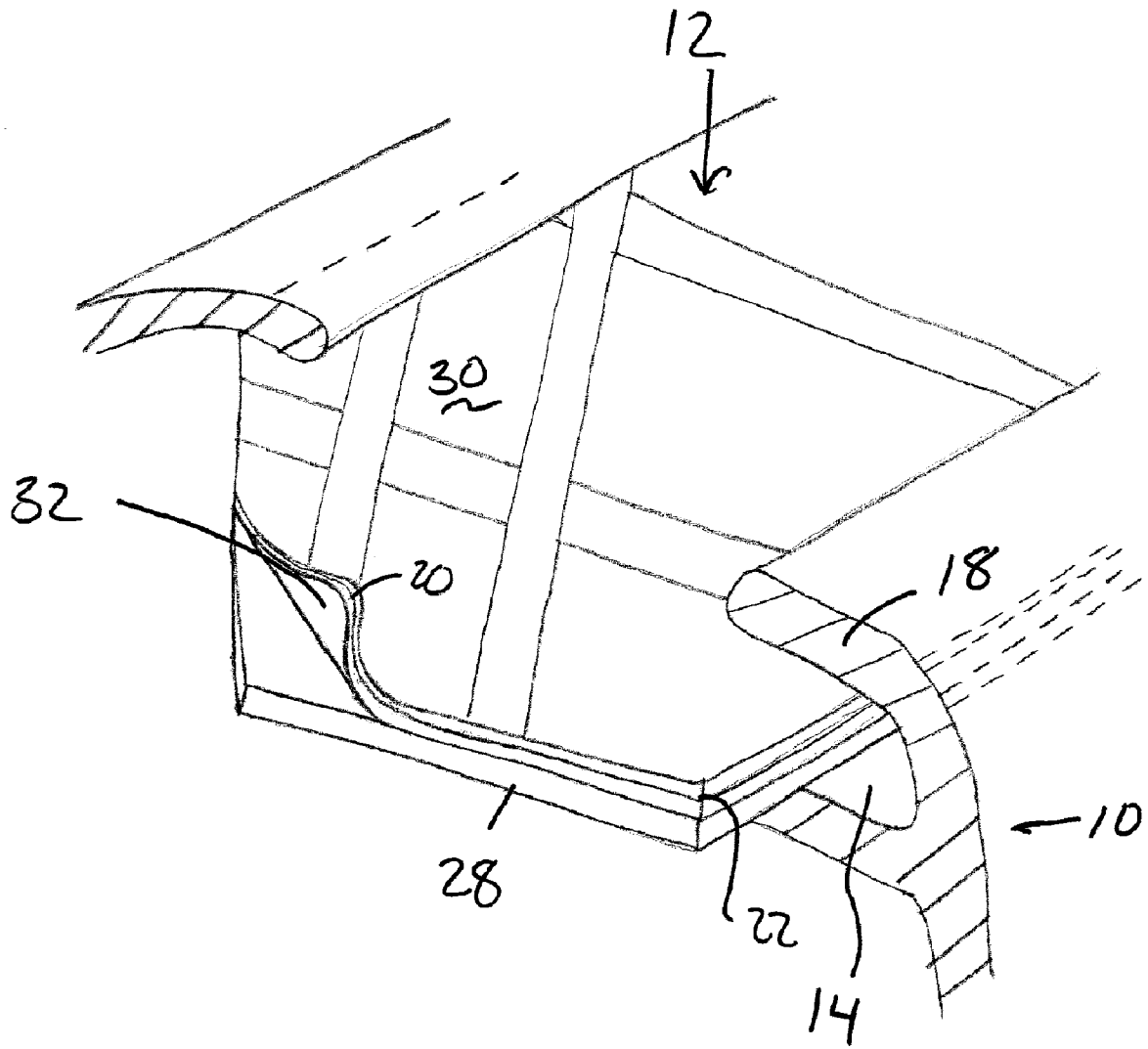
FIG. 5 is a perspective view of a secured removable vamp of the shoe of FIG. 3 according to the present invention.

The shoe of FIGS. 3-5 includes the fixed vamp 14, a magnetic sheet 28, the removable vamp insert 12, the tongue flap 16 and the receiving lip 18. FIG. 4 shows an exploded view of the magnetic sheet 28 and the removable vamp insert 12. FIG. 3 shows the removable vamp insert 12 being held in place on the shoe 10 by the receiving lip 18. FIG. 5 shows a close up of the receiving lip 18 looking from the tongue area downward. FIGS. 3-5 show the addition of the magnetic sheet 28 attached to the fixed vamp 14. In most cases, the magnetic sheet 28 will be permanently mounted to the fixed vamp 14 or formed as part of the fixed vamp 14. The removable vamp insert 12 includes the tongue end 20 which fits under the tongue flap 16. The tongue flap 16 is a piece of material attached to the tongue of the shoe 10 to hold the removable vamp insert 12 in place. The removable vamp insert 12 is placed over the magnetic sheet 28 with the outside edge 22 of the removable vamp insert 12 placed into the receiving lip 18 and with the tongue end 20 placed under the tongue flap 16. The removable vamp insert 12 has an outside layer 30 and an inside layer 32. The outside layer 30 is a decorative layer, which could be anything from a fabric material to a leather material. The inside layer 32 is the part of the removable vamp insert 12 which contacts the magnetic sheet 28 and is a magnetic material which is attracted to the magnetic sheet 28. The magnetic sheet 28 and inside layer 32 of the removable vamp insert can be replaced with attractive materials, such as hook and loop materials. The removable vamp insert 12 can be used with the shoe of FIGS. 3-4 without a tongue flap 16.

Figure 6:
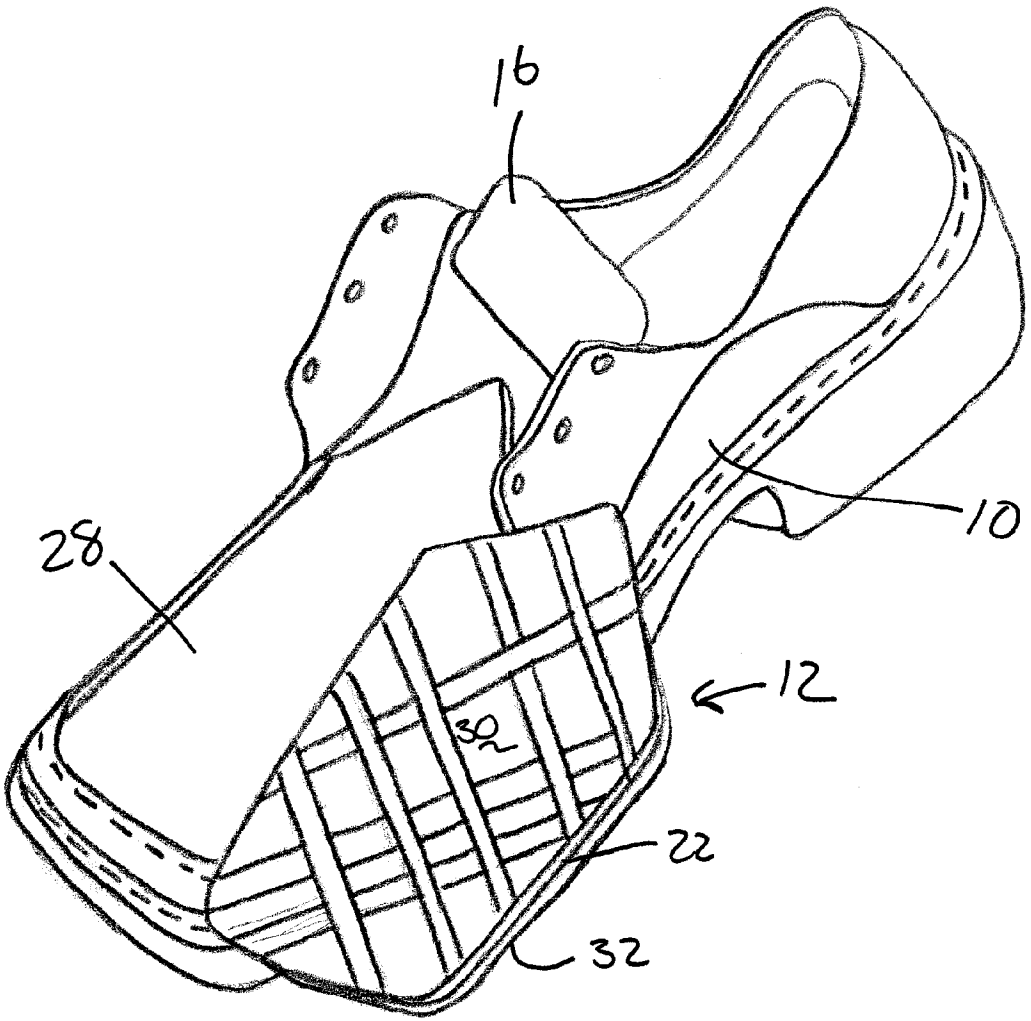
FIG. 6 is a perspective view of another shoe with a removable vamp according to the present invention.

The shoe of FIG. 6 includes the fixed vamp 14, the magnetic sheet 28, the removable vamp insert 12, and the tongue flap 16. There is no receiving lip 18 to hold the removable vamp insert 12 in FIG. 6. FIG. 6 shows the magnetic sheet 28 attached to the fixed vamp 14. In most cases, the magnetic sheet 28 will be permanently mounted to the fixed vamp 14 or formed as part of the fixed vamp 14. The removable vamp insert 12 includes the tongue end 20 which fits under the tongue flap 16. The tongue flap 16 is a piece of material attached to the tongue of the shoe 10 to hold the removable vamp insert 12 in place. The removable vamp insert 12 is placed over the magnetic sheet 28 and with the tongue end 20 placed under the tongue flap 16. The removable vamp insert 12 has the outside layer 30 and the inside layer 32. The outside layer 30 is a decorative layer, which could be anything from a fabric material a leather material. The inside layer 32 is the part of the removable vamp insert 12 which contacts the magnetic sheet 28 and is a magnetic material which is attracted to the magnetic sheet 28. The magnetic sheet 28 and inside layer 32 of the removable vamp insert 12 can be replaced with attractive materials, such as hook and loop materials. The removable vamp insert 12 can be used with the shoe 10 of FIG. 6 without a tongue flap 16.

While different embodiments of the invention have been described in detail herein, it will be appreciated by those skilled in the art that various modifications and alternatives to the embodiments could be developed in light of the overall teachings of the disclosure. Therefore, any combination of the components show in FIGS. 1-6 can be mixed and matched to provide a show using the decorative vamp system. Accordingly, the particular arrangements are illustrative only and are not limiting as to the scope of the invention that is to be given the full breadth of any and all equivalents thereof.

What is claimed is:

1. A shoe with a decorative vamp system, comprising: a shoe, said shoe having a fixed vamp; a removable vamp insert, a receiving lip about said shoe which runs down a length of one side of said shoe from a tongue of said shoe to a toe and around said toe and up an other side of said shoe to said tongue, said receiving lip to receive and secure said removable vamp insert.

2. The shoe with a decorative vamp system of claim 1, wherein said vamp insert includes outside layer and an inside layer, said outside layer faces out from said shoe, said inside layer is separate and of a different material than said outside layer and wherein said inside layer provides a frictional force between said vamp insert and the fixed vamp of the shoe.

3. The decorative vamp system of claim 2, further including at least one hook and loop fastener attached to said inside layer of said vamp insert and the fixed vamp of the shoe to provide said frictional force.

4. The decorative vamp system of claim 2, further including attractive magnets mounted to said inside layer of said vamp insert and mounted to the fixed vamp of the shoe to provide said frictional force.

5. The shoe with a decorative vamp system of claim 1, wherein said shoe includes a tongue flap to secure one end of said removable vamp insert between said tongue flap and said shoe.

6. The shoe with a decorative vamp system of claim 5, wherein said vamp insert includes outside layer and an inside layer, said outside layer faces out from said shoe, said inside layer is separate and of a different material than said outside layer and wherein said inside layer provides a frictional force between said vamp insert and the fixed vamp of the shoe.

7. The decorative vamp system of claim 6, further including at least one hook and loop fastener attached to said inside layer of said vamp insert and the fixed vamp of the shoe to provide said frictional force.

8. The decorative vamp system of claim 6, further including attractive magnets mounted to said inside layer of said vamp insert and mounted to the fixed vamp of the shoe to provide said frictional force.

9. The decorative vamp system of claim 5, further including at least one hook and loop fastener attached to said inside layer of said vamp insert and the fixed vamp of the shoe to provide said frictional force.

10. The decorative vamp system of claim 5, further including attractive magnets mounted to said inside layer of said vamp insert and mounted to the fixed vamp of the shoe to provide said frictional force.

11. The decorative vamp system of claim 1, further including at least one hook and loop fastener attached to said inside layer of said vamp insert and the fixed vamp of the shoe to provide said frictional force.

12. The decorative vamp system of claim 1, further including attractive magnets mounted to said inside layer of said vamp insert and mounted to the fixed vamp of the shoe to provide said frictional force.

13. The decorative vamp system of claim 5, further including at least one hook and loop fastener attached to said inside layer of said vamp insert and the fixed vamp of the shoe to provide said frictional force.

14. The decorative vamp system of claim 5, further including attractive magnets mounted to said inside layer of said vamp insert and mounted to the fixed vamp of the shoe to provide said frictional force.

* * * * *